US005380416A

United States Patent [19]

McMinn

[11] Patent Number: 5,380,416

[45] Date of Patent: Jan. 10, 1995

[54] ALUMINUM REDUCTION CELL CARBON ANODE POWER CONNECTOR

[75] Inventor: Curtis J. McMinn, Florence, Ala.

[73] Assignee: Reynolds Metals Company, Richmond, Va.

[21] Appl. No.: 161,836

[22] Filed: Dec. 2, 1993

[51] Int. Cl.[6] ..... C25C 3/08

[52] U.S. Cl. ..... 204/245; 204/243 R; 204/279; 204/286

[58] Field of Search ..... 204/243 R, 279, 293, 204/286, 245; 373/88, 89, 102; 420/34, 105, 104; 148/333, 334, 320; 252/513

[56] References Cited

U.S. PATENT DOCUMENTS

| | | | |
|---|---|---|---|
| 4,354,918 | 10/1982 | Boxall et al. | 204/286 |
| 4,612,105 | 9/1986 | Langon | 204/286 |
| 4,626,333 | 12/1986 | Secrist et al. | 204/286 |
| 5,154,813 | 10/1992 | Dill | 204/286 |

*Primary Examiner*—Kathryn Gorgos
*Attorney, Agent, or Firm*—Alan T. McDonald

[57] ABSTRACT

An electrical connector for use in an aluminum reduction cell is disclosed. The portion of the connector extending into the carbon anode block is formed from a steel alloy having at least about 0.8% by weight chromium and having electrical resistivity characteristics close to those of mild steel at the cell operating temperatures of the block.

3 Claims, 3 Drawing Sheets

ALUMINUM REDUCTION CELL CARBON ANODE POWER CONNECTOR

FIELD OF THE INVENTION

This invention relates to stubs and pins for conducting electric power into carbon anodes of aluminum reduction cells.

BACKGROUND OF THE INVENTION

Hall-Heroult aluminum reduction cells have carbon anodes in contact with a molten electrolyte of alumina dissolved in cryolite. Current carrying steel stubs or pins are embedded in the carbon anodes above the bath level. The carbon is prebaked outside of the pot or is baked during cell operation. If prebaked, a pair of steel stubs are inserted in an opening into the top of a carbon block and secured there by pouring molten iron into the space between the stub and the carbon. If baked during operation, a Soderberg cell is used in which vertical steel pins or steel side pins are inserted into green carbon which is progressively baked by the heat of the bath below.

Mild steel has long been the preferred metal of such stubs or pins, because of its strength (especially in forged form), its retention of strength at cell temperatures, its relatively high electrical conductivity, and what has been considered acceptable corrosion resistance. Its relatively low material cost per pound is a favorable factor, but of limited importance.

As noted in U.S. Pat. No. 5,154,813 of Raymond J. Dill, issued Oct. 13, 1992, mild steel stubs corrode particularly where they enter a prebaked carbon anode block, to such an extent as to neck in the stub near its entry and thereby increase electrical resistivity to the point where the stub has to be removed sooner than desired, and replaced instead of reinstalled. Excessive corrosion may also occur where mild steel pins are embedded in the baked carbon of Soderberg anodes. In both cases corrosion may be accentuated through action of sulfates derived from sulfur in the carbon used in the cell.

The Dill patent discloses protecting the mild steel stubs of prebaked carbon anodes by coating them with a corrosion resistant material such as metalized or welded stainless steel. This preserves the advantage of conductivity of the mild steel, which continues to carry the current independently of any conductivity of the coating. However, applying such a coating is an expense to begin with, and is vulnerable to deterioration in the course of first use and subsequent removal, cleaning and reuse to which mild steel stubs and pins are commonly subjected.

SUMMARY OF INVENTION

In accordance with the present invention, the mild steel of conventional current carrying stubs and pins for carbon anodes of aluminum reduction cells is replaced by a steel alloy containing at least about 0.08% chromium and optionally at least about 0.15% molybdenum, in order to obtain the benefit of a substantial increase of corrosion resistance with only a small loss of electrical conductivity compared to a corresponding stub or pin of mild steel.

In the case of stubs for prebaked carbon anodes of aluminum reduction cells, a steel alloy containing about 1% by weight of chromium and about 0.2% molybdenum, such as AISI 4130, is preferable for the purposes of the invention. Such an alloy has an electrical resistance close to that of mild steel at all relevant temperatures (about 500° to 800° C.), as shown in FIG. 4, and has much better corrosion resistance (about 25% to 50%) than a stub of a typical mild steel, such as AISI 1008, in the area around entry of the stub into the carbon anode block, where the most severe corrosion is found.

In the case of Soderberg anodes, vertical and side pins for the carbon anodes are also improved by use of a low chromium, molybdenum steel alloy, such as AISI 4130, but the chromium content can be increased to about 18% for further improved corrosion resistance with about the same low increase of resistivity of the pins, because pin corrosion occurs substantially entirely inside of the carbon anodes, at temperatures of about 800° to 950° C. As shown in FIG. 4, at this high range of operating temperatures, an 18% chromium steel alloy, such as 304SS, has an electrical resistivity only about 6% higher than a mild steel such as alloy AISI 1008, but has much greater corrosion resistance where the corrosion is greatest. 304SS contains no molybdenum.

Further objects, advantages and details of the invention become apparent as the following disclosure proceeds.

BRIEF DESCRIPTION OF THE DRAWINGS

Present preferred embodiments of the invention as shown in the accompanying drawings, in which.

DETAILED DESCRIPTION OF PRESENT PREFERRED EMBODIMENTS OF THE INVENTION

Figure 1:
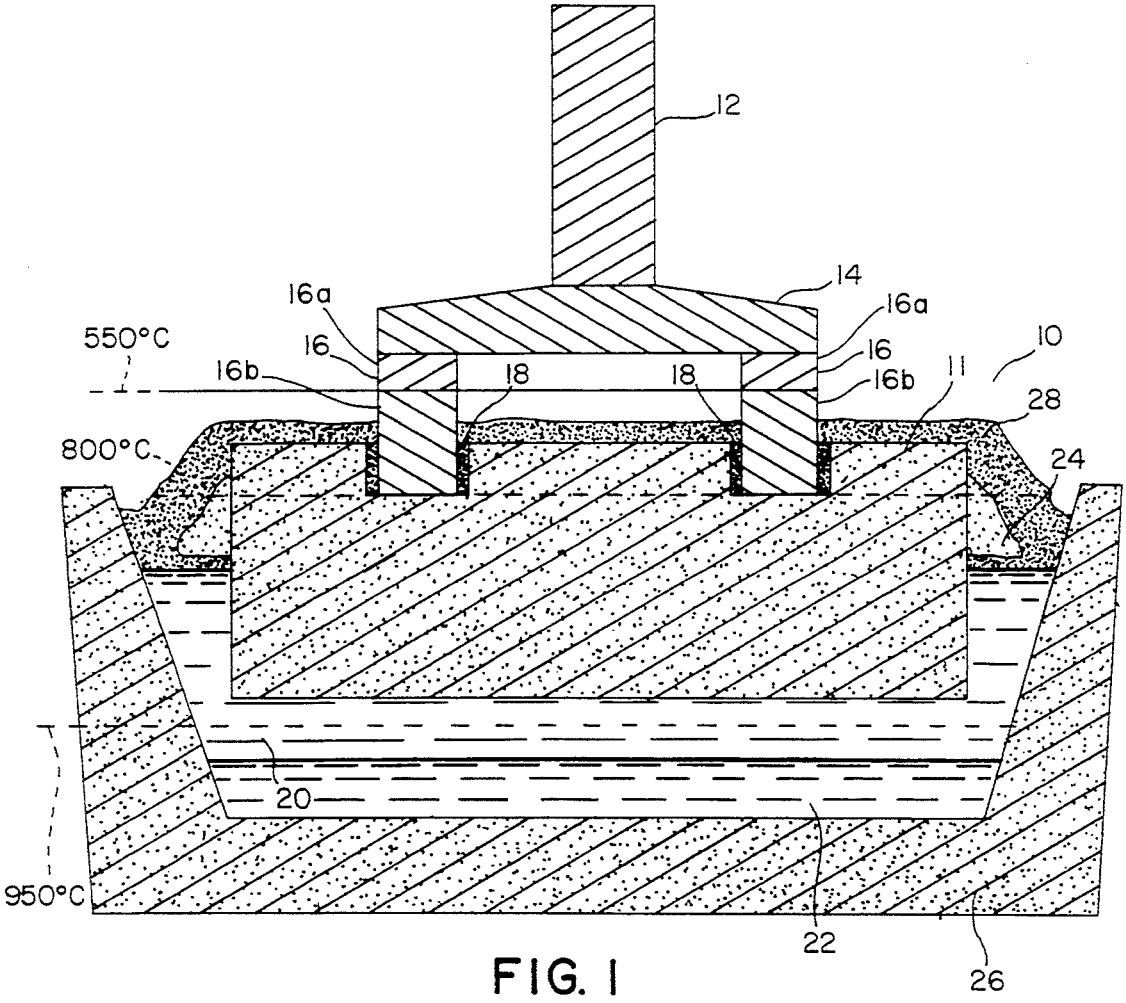
FIG. 1 is a schematic view of a vertical section through an aluminum reduction cell having a prebaked carbon anode.

Referring now to the accompanying drawings, and initially to FIG. 1, there is shown an aluminum electrolytic reduction cell 10 having a prebaked carbon block anode 11 suspended from an electrically conductive stem 12, yoke 14 and pair of cylindrical steel stubs 16. The lower end of each stub 16 is embedded in the block 11 and secured to the block by cast iron 18 pour into space between the block and the side of each stub. The lower end of the block is immersed in a bath 20 of alumina dissolved in cryolite. The bath 20 floats of a pad of molten aluminum 22, and a crust 24 of cryolite and alumina floats on bath 20 around block 11. A pot having a carbon lining 26 contains bath 20, pad 22 and crust 24. A cover 28 of particles of alumina or reclaimed cryolite or both may extend over block 11 and outwardly to liner 26 and portions of crust 24 along liner 26.

Each stub 16 has an upper portion **16*a* spaced above the top of anode block 11, and an integrally joined lower portion 16*b* extending down from the bottom of upper portion 16*a* into anode block 11. The juncture of the two portions is preferably at an operating temperature not in excess of about 550° C. The temperature level at the bottom of stub 16 may be about 800° C. and higher temperatures normally developed further down, such as about 950° C. closely below the bottom of anode block 11, as shown in FIG. 1**.

Corrosion of each stub 16 occurs principally in a band around the stub portion 16*b* where the stub enters block 11. Any resultant loss of a cross-sectional area of the stub where corrosion occurs has the effect of increasing electrical resistivity of the stub, thereby interfering with the primary function of the stub as an electrical conductor into the anode block 11. In accordance with the invention, this can be advantageously offset by making the stub portion 16*b* having a chromium content of at least about 0.8% by weight and optionally and preferably a molybdenum content of at least about 0.15% by weight, and having an electrical resistivity while in the temperature range of about 550° to 800° C. close to that of a mild steel such as AISI C 1008, and also has corrosion resistance when used in stub portion 16*b* like that of steel alloy AISI 4130, which is the present preferred example of such low alloy. Stub portion 16*a* may be made of mild steel welded or otherwise secured to the stub portion 16*b*, or substantially the whole length of stub 16 may be made in one piece of the same corrosion resistant low alloy steel, for convenience of manufacture, especially if that includes forging.

Figure 2:
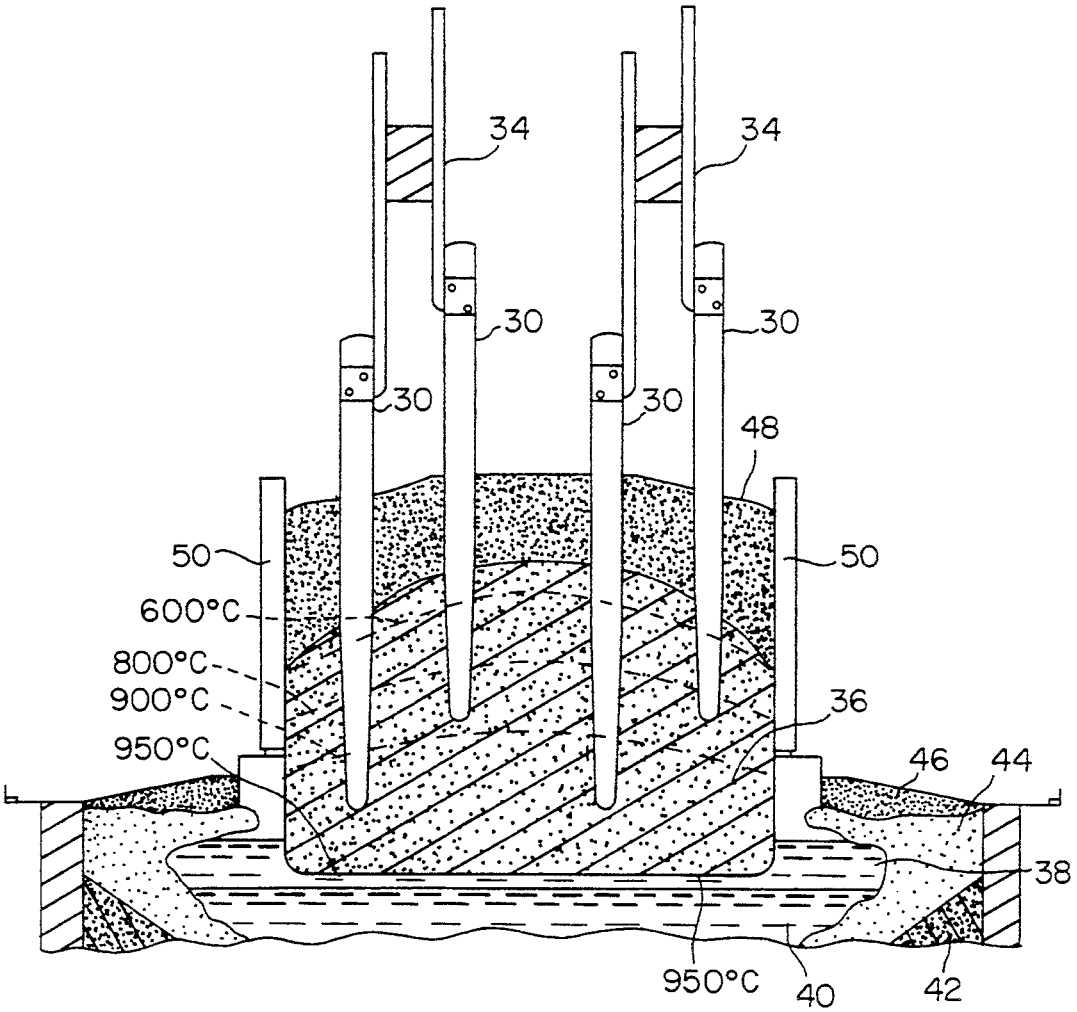
FIG. 2 shows a like section through a vertical pin Soderberg aluminum reduction cell.

Referring now to FIG. 2, there is shown a Soderberg aluminum electrolytic reduction cell 30 having vertical pins 32. The upper portion of the pins receive electric power from supporting hangers 34, and the lower ends of the pins extend into a carbon block anode 36 and the lower end of the block is immersed in a molten bath 38 of alumina dissolved in cryolite. The bath 38 floats on a pad 40 of molten aluminum and both are retained within a carbon pot lining 42 which includes a carbon cathode block beneath anode block 36.

Uncured "green" carbon 48 is periodically added to the top of block 36, which is baked by the heat of the cell operation. The green carbon 48 and block 36 are of constant rectangular horizontal cross-section and are shaped and supported between vertical walls 50 around all four sides. They are capable of adjustment to enable carbon block 36 to move down when its lower end is consumed. The pins 30 are inserted individually at varying times into the green carbon, where they remain and become baked into block 36. When the lower ends of one or more pins 30 come too close to the lower end of block 36, they are detached from their hangers, twisted free of the surrounding baked carbon, and removed from the cell for cleaning and later return if still in good condition. Such twisting imposes strains on the pins, so it is conventional for mild steel pins to be forged.

The temperatures of the block 36 are at about 600° C. where baking of the green carbon begins (as shown by a dotted line marked with that temperature in FIG. 2), are about 900° C. about midway between where baking begins and the bottom of block 36 (as shown by a similar dotted line marked with the temperature), and are about 950° C. along the bottom surface of block 36.

The pins conduct little or no current into the green carbon 48, which has high electrical resistivity. The more a pin extends into the fully baked carbon the more it conducts current into the block 36. The lowest pins carry most of the current and have most of their conductive length in the temperature range of about 800° to 950° C. Consequently, although the pins 30 can be improved in accordance with the invention by making them of a corrosion resistant steel alloy having only about 1% chromium content by weight AISI 4130 steel alloy shown in FIG. 4, they can be further improved by making them of a more corrosion resistant steel alloy having a chromium content of about 18% by weight, such as the AISI 304SS alloy shown in FIG. 4. The higher chromium content imposes substantially no penalty of higher resistivity in the temperature range of about 800° to 1000° C. The use of such high or low chromium alloys can be for the whole of each pin 30, or only for the part of each pin (about half of the pin length, including the tapered end) which becomes baked into the block 36. In the latter case, the remainder of the pin length is made of mild steel and is welded or otherwise secured to the first part.

Figure 3:
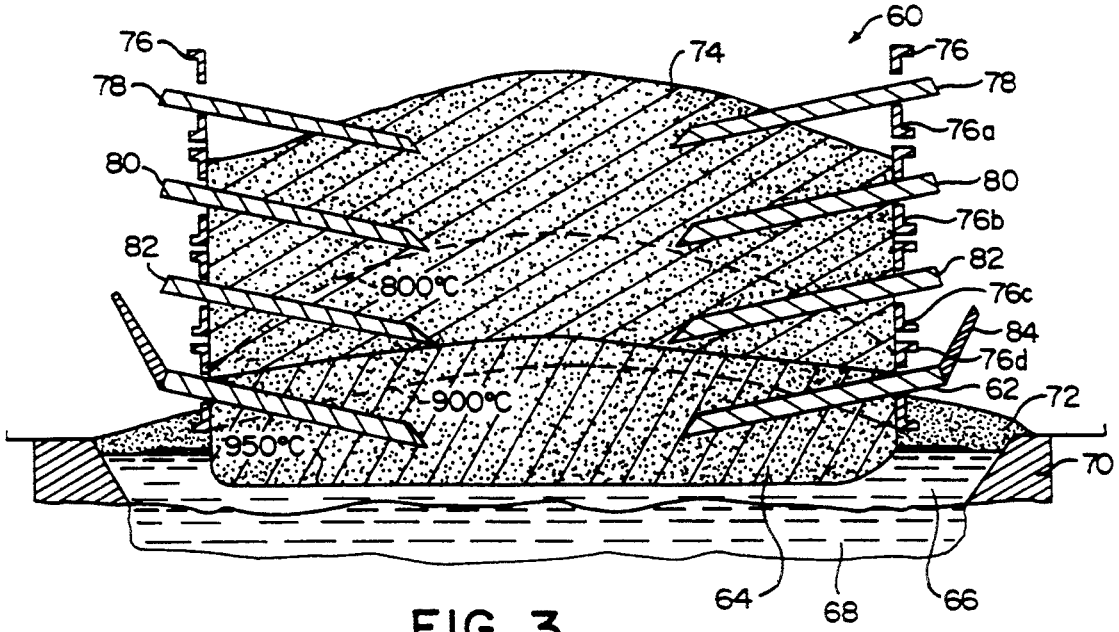
FIG. 3 shows a like section through a side pin Soderberg aluminum reduction cell.

Referring now to FIG. 3, there is shown a Soderberg aluminum reduction cell 60 having pins 62 extending from opposite sides of an anode block 64 of carbon which has been baked by the heat of the cell. The lower end of the block is immersed in a molten bath 66 of alumina dissolved in cryolite. The bath 66 floats on a pad of molten aluminum 68, and both are retained within a carbon pot lining 70 which includes a carbon cathode block spaced below anode block 64.

Green carbon 74 rests on top of anode block 64, and both are of rectangular horizontal cross-section and are held between four side walls 76 each horizontally divided into four separable sections 76*a*, 76*b*, 76*c*, and 76*d*. A pair of oppositely extending rows of pins 78 extend through openings through a pair of opposite top wall sections 76*a*, a pair of rows of pins 80 similarly extend through the next lower wall sections 76*b*, another pair of rows of pins 82 similarly extend through the next lower wall sections 76*c* and the pins 62 similarly extend through the lowermost wall sections 76*d*, and at their outer ends are connected to an electric power source through connectors 84. The upper rows of pins 78, 80 and 82 extend into the green carbon 74, and are not connected to any power source as long as pins 62 remain in place as shown in FIG. 3. When the lower end of carbon anode block 64 wears away sufficiently, pins 62 are twisted to break them away from block 64, and are removed for cleaning and possible reuse. The lowermost wall sections 76*d* are then removed, the wall sections 76*a*, *-d* and *-c* are lowered with their pins in place, the wall sections 76*d* are remounted above wall sections 76*a*, additional green carbon is supplied, replacement pins are inserted through the pin openings through the remounted wall sections 76*d*, and the pins 82 are connected to the power source to which the pins 62 had previously been connected.

When the pins 78, 80 and 82 are not connected to the power source, their electrical resistivity is irrelevant. When any set of pins reach the position of pins 62 shown in FIG. 3, the previously green carbon around them has become baked and part of anode block 64, where all of the length of each pin within the block is in a temperature range of 800° to 950° C. while cell 60 is operating; see the temperature levels illustrated in FIG. 3. Consequently, while a steel alloy containing at least about 0.8% chromium by weight (such as the AISI 4130 steel alloy shown in FIG. 4) could be used to make the pins 62, 78, 80 and 82, a steel or alloy having about 18% chromium content by weight and having the electrical resistivity characteristics of the AISI 304SS steel alloy shown in FIG. 4, could be used instead for better corrosion resistance with minimum loss of electrical conductivity.

In case of Soderberg cells such as shown in FIGS. 2 and 3, corrosion is greatest within the anode block, in a reducing atmosphere, rather than adjacent entry of the pins into the block, in an oxidizing atmosphere, as in the case of the stubs of prebaked anode blocks such as shown in FIG. 1. In both cases, sulfur compounds are sometimes a source of corrosion as well as the fluorine compounds from the electrolyzing bath. While not wishing to be limited to any given theory, it is believed that when present the molybdenum improves the adherence of sulfide scale and, thus, slows corrosion by sulfur compounds present in the reduction cell.

Figure 4:
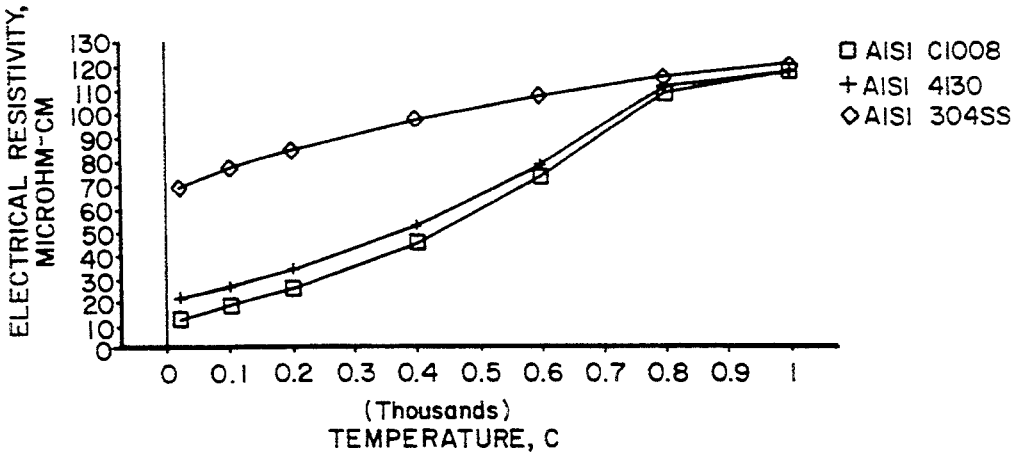
FIG. 4 is a diagram showing electrical resistivity of certain steel alloys over a range of temperatures from 0° to 1000° C.

The compositions of the three steel alloys shown in FIG. 4 are as follows:

| | Composition, Percent | | |
|---|---|---|---|
| Component | AISI C 1008 | AISI 4130 | AISI 304SS |
| Carbon (C) | 0.10 max. | 0.28–0.33 | 0.08 max. |
| Manganese (Mn) | 0.25–0.50 | 0.40–0.60 | 2.00 max. |
| Chromium (Cr) | — | 0.80–1.10 | 18.0–20.0 |
| Molybdenum (Mo) | — | 0.15–0.25 | — |
| Nickel (Ni) | — | — | 8.0–11.0 |
| Phosphorus (P) | 0.040 max. | 0.040 max. | — |
| Sulfur (S) | 0.050 max. | 0.040 max. | — |
| Silicon (Si) | — | 0.20–0.35 | — |
| Iron (Fe) | Balance | Balance | Balance |

While present preferred embodiments and practices of the invention have been illustrated and described, it is understood that the invention is not limited thereto, but rather is limited by the appended claims.

What is claimed is:

1. In an electrolytic aluminum reduction cell comprising a carbon anode block and electrical connectors, each connector having a portion thereof subject to corrosion during operation of the cell and the portion is at least partially extending into the block, the improvement wherein at least the portion of each of the connectors subject to corrosion during operation of the cell is formed entirely of a steel alloy containing at least about 0.8% by weight of chromium and has electrical resistivity characteristics close to those of mild steel at operating temperatures of the block where the connectors are present.

2. An electrolytic aluminum reduction cell according to claim 1, wherein the cell is a Soderberg cell and at least the portion of each of the electrical connectors subject to corrosion during operation of the cell has a chromium content of about 18% by weight.

3. An electrolytic aluminum reduction cell according to claim 1, wherein the carbon anode is prebaked outside of the cell, and at least the portion of each of the electrical connectors subject to corrosion during operation of the cell has a chromium content of about 1% by weight and a molybdenum content of about 0.2% by weight.

* * * * *